US008715897B2

(12) United States Patent
Bayley et al.

(10) Patent No.: US 8,715,897 B2
(45) Date of Patent: May 6, 2014

(54) TONER COMPOSITIONS

(75) Inventors: Robert D. Bayley, Fairport, NY (US); Yuhua Tong, Webster, NY (US); Timothy L. Lincoln, Rochester, NY (US); Grazyna Kmiecik-Lawrynowicz, Fairport, NY (US); Maura A. Sweeney, Irondequoit, NY (US)

(73) Assignee: Xerox Corporation, Norwalk, CT (US)

( * ) Notice: Subject to any disclaimer, the term of this patent is extended or adjusted under 35 U.S.C. 154(b) by 546 days.

(21) Appl. No.: 12/618,981

(22) Filed: Nov. 16, 2009

(65) Prior Publication Data

US 2011/0117486 A1 May 19, 2011

(51) Int. Cl.
*G03G 9/00* (2006.01)

(52) U.S. Cl.
USPC ..... 430/108.24; 430/108.3; 430/108.4; 430/137.1; 430/137.14; 430/137.15; 430/137.17

(58) Field of Classification Search
USPC ..... 430/137.1, 137.14, 137.17, 137.15, 430/108.24, 108.4, 108.3
See application file for complete search history.

(56) References Cited

U.S. PATENT DOCUMENTS

| | | | | |
|---|---|---|---|---|
| 2,874,063 | A | 2/1959 | Greig | |
| 3,590,000 | A | 6/1971 | Palermiti et al. | |
| 4,265,990 | A | 5/1981 | Stolka et al. | |
| 4,563,408 | A | 1/1986 | Lin et al. | |
| 4,584,253 | A | 4/1986 | Lin et al. | |
| 4,935,326 | A | 6/1990 | Creatura et al. | |
| 4,937,166 | A | 6/1990 | Creatura et al. | |
| 5,223,368 | A | 6/1993 | Ciccarelli et al. | |
| 5,290,654 | A | 3/1994 | Sacripante et al. | |
| 5,302,486 | A | 4/1994 | Patel et al. | |
| 5,324,613 | A | 6/1994 | Ciccarelli et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,853,943 | A | 12/1998 | Cheng et al. | |
| 5,998,073 | A * | 12/1999 | Kuramoto et al. | 430/109.2 |
| 6,063,827 | A | 5/2000 | Sacripante et al. | |
| 6,165,668 | A | 12/2000 | Wilson et al. | |
| 6,214,507 | B1 | 4/2001 | Sokol et al. | |
| 6,221,550 | B1 | 4/2001 | Wilson et al. | |
| 6,593,049 | B1 | 7/2003 | Veregin et al. | |
| 6,652,634 | B1 | 11/2003 | Akers, Jr. et al. | |
| 6,756,176 | B2 | 6/2004 | Stegamat et al. | |
| 6,830,860 | B2 | 12/2004 | Sacripante et al. | |
| 7,378,207 | B2 | 5/2008 | Oyama et al. | |
| 2002/0172880 | A1 * | 11/2002 | Takayanagi et al. | 430/108.23 |
| 2003/0191263 | A1 | 10/2003 | Yoshida et al. | |
| 2004/0002014 | A1 | 1/2004 | Chae et al. | |
| 2006/0222991 | A1 | 10/2006 | Sacripante et al. | |
| 2008/0076054 | A1 * | 3/2008 | Nozaki et al. | 430/110.2 |
| 2008/0193869 | A1 * | 8/2008 | Vanbesien et al. | 430/108.4 |
| 2008/0236446 | A1 * | 10/2008 | Zhou et al. | 106/31.25 |

FOREIGN PATENT DOCUMENTS

| | | | |
|---|---|---|---|
| EP | 1 383 011 | A1 | 1/2004 |
| EP | 1 426 830 | A1 | 6/2004 |

* cited by examiner

*Primary Examiner* — Throl Chea
(74) *Attorney, Agent, or Firm* — MDIP LLC

(57) ABSTRACT

The present disclosure provides polyesters suitable for use in forming toners. In embodiments, a polyester may be subjected to phase inversion emulsification, in which charge control agents are added so that the polyester emulsion includes charge control agents therein. The resulting polyester emulsion with charge control agents may then be utilized to form toner particles.

10 Claims, No Drawings

TONER COMPOSITIONS

BACKGROUND

The present disclosure relates to toners and processes useful in providing toners suitable for electrostatographic apparatuses, including xerographic apparatuses such as digital, image-on-image, and similar apparatuses.

Numerous processes are within the purview of those skilled in the art for the preparation of toners. Emulsion aggregation (EA) is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component development systems (SCD), which may use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

Charge control agents may be utilized to enhance triboelectric charging. Charge control agents may include organic salts or complexes of large organic molecules. Such agents may be applied to toner particle surfaces by a blending process. Such charge control agents may be used in small amounts of from about 0.01 weight percent to about 5 weight percent of the toner to control both the polarity of charge on a toner and the distribution of charge on a toner. Although the amount of charge control agents may be small compared to other components of a toner, charge control agents may be important for triboelectric charging properties of a toner. These triboelectric charging properties, in turn, may impact imaging speed and quality. Examples of charge control agents include those found in EP Patent Application No. 1426830, U.S. Pat. No. 6,652,634, EP Patent Application No. 1383011, U.S. Patent Application Publication No. 2004/0002014, U.S. Patent Application Publication No. 2003/0191263, U.S. Pat. No. 6,221,550, and U.S. Pat. No. 6,165,668, the disclosures of each of which are totally incorporated herein by reference.

Improved methods for producing toner, which decrease the production time and permit excellent control of the charging of toner particles, remain desirable.

SUMMARY

The present disclosure provides resin emulsions, processes for forming same, and the use of these emulsions in forming toner particles.

In embodiments, a process of the present disclosure may include contacting at least one polyester resin with at least one charge control agent and at least one organic solvent to form a resin mixture; heating the resin mixture to a desired temperature; adding water and an optional solvent inversion agent to the mixture; and removing the solvent to form an emulsion including the at least one polyester and the charge control agent in the disperse phase.

In other embodiments, a process of the present disclosure may include contacting at least one polyester resin possessing with at least one charge control agent derived from at least one metal complex of a component such as alkyl derivatives of salicylic acid, alkyl derivatives of benzoic acid, alkyl derivatives of dicarboxylic acid derivatives, alkyl derivatives of oxynaphthoic acid, alkyl derivatives of sulfonic acids, dimethyl sulfoxide, polyhydroxyalkanoate, quaternary phosphonium trihalozincate, and combinations thereof, and at least one organic solvent such as alcohols, esters, ethers, ketones, amines, and combinations thereof, in an amount from about 10 percent by weight to about 90 percent by weight of the resin, to form a resin mixture; heating the mixture to a desired temperature; diluting the mixture to a desired concentration by adding at least one solvent inversion agent to form a diluted mixture; adding water, in embodiments dropwise, to the diluted mixture until phase inversion occurs to form a phase inversed mixture; removing the solvents from the phase inversed mixture to form an emulsion including the at least one polyester and the charge control agent in the disperse phase; and utilizing the emulsion to form toner particles.

A resin emulsion of the present disclosure may include a continuous phase; and a disperse phase including at least one polyester resin in combination with at least one charge control agent derived from at least one metal complex of a component such as alkyl derivatives of salicylic acid, alkyl derivatives of benzoic acid, alkyl derivatives of dicarboxylic acid derivatives, alkyl derivatives of oxynaphthoic acid, alkyl derivatives of sulfonic acids, dimethyl sulfoxide, polyhydroxyalkanoate, quaternary phosphonium trihalozincate, and combinations thereof, and at least one organic solvent such as alcohols, esters, ethers, ketones, amines, and combinations thereof, wherein the charge control agent is present in an amount of from about 0.01 percent by weight to about 10 percent by weight of the emulsion.

DETAILED DESCRIPTION OF EMBODIMENTS

The present disclosure provides toners and processes for the preparation of toner particles having excellent charging characteristics. Processes of the present disclosure may be used to produce emulsified resin particles that also include a charge control agent within the emulsion particles. The resulting emulsions may then be utilized to form toners.

In embodiments, toners of the present disclosure may be prepared by combining a latex polymer, a charge control agent, optionally in an emulsion, an optional colorant, an optional wax, and other optional additives. While the latex polymer may be prepared by any method within the purview of those skilled in the art, in embodiments the latex polymer may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. Suitable monomers useful in forming a latex polymer emulsion, and thus the resulting latex particles in the latex emulsion, include, but are not limited to, polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

In embodiments, the resins may be an amorphous resin, a crystalline resin, and/or a combination thereof. In further embodiments, the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like including their structural isomers. The aliphatic diol may be, for example, selected in an amount of from about 40 to about 60 mole percent, in embodiments from about 42 to about 55 mole percent, in embodiments from about 45 to about 53 mole percent, and a second diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent, in embodiments from about 42 to about 52 mole percent, in embodiments from about 45 to about 50 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), polyethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

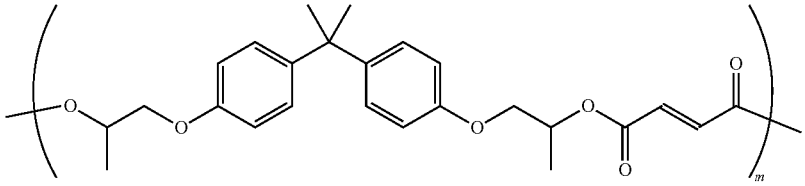

(I)

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

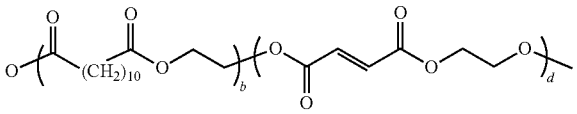

(II)

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a latex emulsion.

The amorphous resin may be present, for example, in an amount of from about 30 to about 90 percent by weight of the toner components, in embodiments from about 40 to about 80 percent by weight of the toner components. In embodiments, the amorphous resin or combination of amorphous resins utilized in the latex may have a glass transition temperature of from about 30° C. to about 80° C., in embodiments from about 35° C. to about 70° C. In further embodiments, the combined resins utilized in the latex may have a melt viscosity of from about 10 to about 1,000,000 Pa*S at about 130° C., in embodiments from about 50 to about 100,000 Pa*S.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 10% (first resin)/90% (second resin) to about 90% (first resin)/10% (second resin), Where the resin includes an amorphous resin and a crystalline resin, the weight ratio of the two resins may be from about 99% (amorphous resin): 1% (crystalline resin), to about 1% (amorphous resin): 90% (crystalline resin).

Charge Control Agents

As noted above, in embodiments a charge control agent (CCA) may be added during formation of the latex containing the polymer. The use of a CCA may be useful for obtaining desirable triboelectric charging properties of a toner, because it may impact the imaging speed and quality of the resulting toner. However, poor CCA incorporation with toner binder resins or surface blending may result in unstable triboelectric charging and other related issues for toner. This poor incorporation may also be a problem for toners produced during an EA particle formation process when a CCA is added. For example, in some cases, where about 0.5% by weight of a CCA is added during an EA particle formation process, the actual amount of CCA remaining in the toner may be as low as about 0.15% by weight.

In contrast, the processes of the present disclosure may provide improved incorporation of a CCA into an emulsion later utilized to form a toner, compared with adding the CCA during an EA process in particulate form, as is done for conventionally processed, i.e., non-EA, toners.

In accordance with the present disclosure, phase inversion emulsification may be utilized to incorporate organic soluble CCAs into an emulsion that may then be utilized to form toner compositions.

Suitable charge control agents which may be utilized include, in embodiments, organic solvent soluble metal complexes of: alkyl derivatives of acids such as salicylic acid, benzoic acid, dicarboxylic acid derivatives, oxynaphthoic acid, and sulfonic acid; dimethyl sulfoxide, polyhydroxyalkanoate quaternary phosphonium trihalozincate, combinations thereof, and the like. Metals utilized in forming such complexes include, but are not limited to, zinc, aluminum, manganese, iron, calcium, zirconium, chromium, combinations thereof, and the like. Alkyl groups which may be utilized in forming derivatives of the acids include, but are not limited to, butyl, methyl, t-butyl, hexyl, propyl, combinations thereof and the like. Examples of such charge control agents include those commercially available as BONTRON® E-84 and BONTRON® E-88 (commercially available from Orient Chemical). BONTRON® E-84 is a zinc complex of 3,5-di-tert-butylsalicylic acid in powder form. BONTRON® E-88 is a mixture of hydroxyaluminium-bis[2-hydroxy-3,5-di-tert-butylbenzoate] and 3,5-di-tert-butylsalicylic acid. Other CCA's suitable are the calcium complex of 3,5-di-tert-butylsalicylic acid, a zirconium complex of 3,5-di-tert-butylsalicylic acid, and an aluminum complex of 3,5-di-tert-butylsalicylic acid, as disclosed in U.S. Pat. Nos. 5,223,368 and 5,324,613, the disclosures of each of which are incorporated by reference in their entirety, combinations thereof, and the like.

The particle size of the emulsified resin particles that also include a charge control agent within the aqueous emulsion particles may have a submicron size, for example of about 1 μM or less, in embodiments about 500 nm or less, such as from about 10 nm to about 500 nm, in embodiments from about 50 nm to about 400 nm, in other embodiments from about 100 nm to about 300 nm, in some embodiments about 200 nm. Adjustments in particle size can be made by modifying the ratio of water to resin flow rates, the neutralization ratio, solvent concentration, and solvent composition. The particles thus produced may be negatively or positively charged, depending on the type of CCA used, and may be used alone as a charge control agent for a toner.

The resulting latex may be utilized to produce toners with excellent charging characteristics, with reduced loss of CCA from the toner particle during EA particle formation.

Solvent

The process for producing a phase inversion emulsion (PIE) latex includes, in embodiments, dissolving the polyester in a solvent, sometimes a combination of solvents, and phase separating the polyester by the addition of water. In accordance with the present disclosure, the CCAs described above may be dissolved in the solvent along with the polyester. Thus, upon adding water, phase separation will occur forming a polyester emulsion, with particles or droplets possessing both the polyester and the charge control agent incorporated therein. The solvents may then be removed by vacuum distillation to obtain a polyester emulsion.

In embodiments, any suitable organic solvent that dissolves both the polyester and CCA may be used. For example, in embodiments, suitable solvents include alcohols, esters, ethers, ketones, amines, the like, and combinations thereof, in an amount of, for example, from about 1 percent by weight to about 100 percent by weight resin, in embodiments, from about 10 percent by weight to about 90 percent by weight resin, in embodiments, from about 25 percent by weight to about 85 percent by weight resin. The solvent should be selected so that it is also capable of dissolving the CCA therein, thereby permitting its incorporation into the polyester emulsion.

In embodiments, suitable organic solvents include, for example, methanol, ethanol, propanol, isopropanol, butanol, ethyl acetate, methyl ethyl ketone, combinations thereof, and the like. In embodiments, the organic solvent may be immiscible in water and may have a boiling point of from about 30° C. to about 120° C., in embodiments from about 50° C. to about 100° C.

Any suitable organic solvent may be used to dissolve the resin, for example alcohols, esters, ethers, ketones, amines, combinations thereof, and the like, in an amount of, for example, from about 1% by weight of the resin to about 100% by weight of the resin, in embodiments, from about 10% by weight of the resin to about 90% by weight of the resin, in embodiments from about 25% by weight of the resin to about 85% by weight of the resin. In embodiments, a solvent mixture including isopropyl alcohol (IPA) and methyl ethyl ketone (MEK) or any other suitable combination of suitable organic solvents, for example methanol, ethanol, propanol, isopropanol, butanol, ethyl acetate, methyl ethyl ketone, and the like, may be used.

Any suitable organic solvent noted hereinabove may also be used as a phase or solvent inversion agent, and may be utilized in an amount of from about 1 percent by weight to about 25 percent by weight of the resin, in embodiments from about 5 percent by weight to about 20 percent by weight of the resin.

Surfactants

In embodiments, the process of the present disclosure may include adding a surfactant to the resin, before or during the mixing at an elevated temperature, thereby enhancing formation of the phase inversed emulsion. In embodiments, the surfactant may be added prior to mixing the resin at an elevated temperature. In embodiments, the surfactant may be added after heating with the addition of water to form the phase inversed latex. Where utilized, a resin emulsion may include one, two, or more surfactants. The surfactants may be selected from ionic surfactants and nonionic surfactants. Anionic surfactants and cationic surfactants are encompassed by the term "ionic surfactants." In embodiments, the surfactant may be added as a solid or as a highly concentrated solution with a concentration of from about 5% to about 100% (pure surfactant) by weight, in embodiments, from about 15% to about 75% by weight. In embodiments, the surfactant may be utilized so that it is present in an amount of from about 0.01% to about 20% by weight of the resin, in embodiments, from about 0.1% to about 10% by weight of the resin, in other embodiments, from about 1% to about 8% by weight of the resin. In embodiments, the surfactant may be added as a solid of from about 1 grams to about 20 grams, in embodiments, of from about 3 grams to about 12 grams.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenc as IGEPAL CA210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108. Combinations of these surfactants and any of the foregoing nonionic surfactants may be utilized in embodiments.

Neutralizing Agent

Once obtained, the resin may be mixed at an elevated temperature, with a highly concentrated base or neutralizing agent added thereto. In embodiments, the base may be a solid or added in the form of a highly concentrated solution.

In embodiments, the neutralizing agent may be used to neutralize acid groups in the resins, so a neutralizing agent herein may also be referred to as a "basic neutralization agent." Any suitable basic neutralization agent may be used in accordance with the present disclosure. In embodiments, suitable basic neutralization agents may include both inorganic basic agents and organic basic agents. Suitable basic agents may include ammonium hydroxide, potassium hydroxide, sodium hydroxide, sodium carbonate, sodium bicarbonate, lithium hydroxide, potassium carbonate, organoamines such as triethyl amine, combinations thereof, and the like.

In embodiments, a latex emulsion may be formed in accordance with the present disclosure which may also include a small quantity of water, in embodiments, de-ionized water (DIW), in amounts of from about 1% by weight of the resin to about 10% by weight of the resin, in embodiments from about 3% by weight of the resin to about 7% by weight of the resin.

The basic agent may be utilized so that it is present in an amount of from about 0.001% by weight to 50% by weight of the resin, in embodiments from about 0.01% by weight to about 25% by weight of the resin, in embodiments from about 0.1% by weight to about 5% by weight of the resin. In embodiments, the neutralizing agent may be added in the form of an aqueous solution.

A solid neutralizing agent may be added in an amount of from about 0.1 grams to about 2 grams, in embodiments from about 0.5 grams to about 1.5 grams.

Utilizing the above basic neutralization agent in combination with a resin possessing acid groups, a neutralization ratio of from about 50% to about 300% may be achieved, in embodiments from about 70% to about 200%. In embodiments, the neutralization ratio may be calculated using the following equation:

$$\text{Neutralization ratio in an equivalent amount of 10\%}\ NH_3/\text{resin(g)/resin acid value}/0.303*100.$$

As noted above, the basic neutralization agent may be added to a resin possessing acid groups. The addition of the basic neutralization agent may thus raise the pH of an emulsion including a resin possessing acid groups to from about 5 to about 12, in embodiments from about 6 to about 11. The neutralization of the acid groups may, in embodiments, enhance formation of the emulsion.

Processing

As noted above, the present process includes mixing at least one resin and at least one charge control agent at an elevated temperature, in the presence of an organic solvent. More than one resin may be utilized. More than one charge control agent may be utilized. As noted above, the resin may be an amorphous resin, a crystalline resin, or a combination thereof. In embodiments, the resin may be an amorphous resin and the elevated temperature may be a temperature above the glass transition temperature of the resin. In other embodiments, the resin may be a crystalline resin and the elevated temperature may be a temperature above the melting point of the resin. In further embodiments, the resin may be a mixture of amorphous and crystalline resins and the temperature may be above the glass transition temperature of the mixture.

Thus, in embodiments, the process of making the emulsion may include contacting at least one resin and at least one charge control agent with an organic solvent, heating the resin mixture to an elevated temperature, stirring the mixture, and, while maintaining the temperature at the elevated temperature, adding a solvent inversion agent to the resin mixture to dilute the mixture to a desired concentration, and adding water dropwise into the mixture until phase inversion occurs to form a phase inversed latex emulsion.

In the phase inversion process, the amorphous and/or crystalline polyester resin, in combination with the charge control agent, may be dissolved in a low boiling organic solvent, which solvent is immiscible in water, such as ethyl acetate, methyl ethyl ketone, or any other solvent noted hereinabove, at a concentration of from about 1 percent by weight to about 75 percent by weight of resin in solvent in embodiments from about 5 percent by weight to about 60 percent by weight. The resin mixture is then heated to a temperature of about 25° C. to about 90° C., in embodiments from about 30° C. to about 85° C. The heating need not be held at a constant temperature, but may be varied. For example, the heating may be slowly or incrementally increased during heating until a desired temperature is achieved.

While the temperature is maintained, the solvent inversion agent may be added to the mixture. The solvent inversion agent, such as an alcohol like isopropanol, or any other solvent inversion agent noted hereinabove, in a concentration of from about 1 percent by weight to about 25 percent by weight of the resin, in embodiments from about 5 percent by weight to about 20 percent by weight, may be added to the heated resin mixture, followed by the dropwise addition of water, or optionally an alkaline base, such as ammonia, until phase inversion occurs (oil in water).

The water and optional surfactant may be metered into the heated mixture at least until phase inversion is achieved. In other embodiments, the water and optional surfactant may be metered into the heated mixture, followed by the addition of an aqueous solution, in embodiments deionized water, until phase inversion is achieved.

In embodiments, a continuous phase inversed emulsion may be formed. Phase inversion can be accomplished by continuing to add optional surfactant and/or water compositions to create a phase inversed emulsion including a disperse phase including droplets possessing the molten ingredients of the resin composition and the CCA, and a continuous phase including the surfactant and/or water composition.

In embodiments, a process of the present disclosure may include heating one or more ingredients of a resin composition to an elevated temperature, stirring the resin composition, and, while maintaining the temperature at the elevated temperature, adding the solvent, charge control agent, and optional surfactant into the mixture to enhance formation of the emulsion including a disperse phase and a continuous phase including the resin composition and CCA, and continuing to add the optional surfactant and/or water until phase inversion occurs to form the phase inversed emulsion.

In embodiments, water may be added into the mixture at a rate of about 0.01 percent by weight to about 10 percent by weight every 10 minutes, in embodiments from about 0.5 percent by weight to about 5 percent by weight every 10 minutes, in other embodiments from about 1 percent by weight to about 4 percent by weight every 10 minutes. The rate of water addition need not be constant, but can be varied.

Although the point of phase inversion may vary depending on the components of the emulsion, the temperature of heating, the stirring speed, and the like, phase inversion may occur when optional surfactant, and/or water has been added so that the resulting resin is present in an amount from about 5 percent by weight to about 70 percent by weight by weight of the emulsion, in embodiments from about 20 percent by weight to about 65 percent by weight by weight of the emulsion, in other embodiments from about 30 percent by weight to about 60 percent by weight by weight of the emulsion.

The charge control agent may thus be present in an amount of from about 0.01 percent by weight to about 10 percent by weight by weight of the emulsion, in embodiments from about 0.02 percent by weight to about 1.5 percent by weight by weight of the emulsion, in other embodiments from about 0.1 percent by weight to about 0.8 percent by weight by weight of the emulsion.

At phase inversion, the resin particles become emulsified and dispersed within the aqueous phase. That is, an oil-in-water emulsion of the resin particles in the aqueous phase is formed. Phase inversion may be confirmed by, for example, measuring via any of the techniques within the purview of those skilled in the art.

Phase inversion may permit formation of the emulsion at temperatures avoiding premature crosslinking of the resin of the emulsion.

Stirring may be utilized to enhance formation of the phase inversed emulsion. Any suitable stirring device may be utilized. The stirring need not be at a constant speed, but may be varied. For example, as the heating of the mixture becomes more uniform, the stirring rate may be increased. In embodiments, the stirring may be at from about 10 revolutions per minute (rpm) to about 5,000 rpm, in embodiments from about 20 rpm to about 2,000 rpm, in other embodiments from about 50 rpm to about 1,000 rpm. In embodiments, a homogenizer (that is, a high shear device), may be utilized to form the phase inversed emulsion, but in other embodiments, the process of the present disclosure may take place without the use of a homogenizer. Where utilized, a homogenizer may operate at a rate of from about 3,000 rpm to about 10,000 rpm.

In embodiments, the preparation of polyester emulsions of the present disclosure may include dissolution of at least one resin in at least one organic solvent, heating the mixture to an elevated temperature, adding a charge control agent thereto, inversion of the mixture through mixing with an optional solvent inversion agent and water, and finally distillation of the solvent from the emulsion. This process offers several advantages over current solvent-based processes for the formation of emulsions both at the laboratory and industrial scale.

Following phase inversion, additional surfactant, and/or water may optionally be added to dilute the phase inversed emulsion, although this is not required. Following phase inversion, the phase inversed emulsion may be cooled to room temperature, for example from about 20° C. to about 25° C.

In embodiments, distillation, such as vacuum distillation, with stirring of the organic solvent may be performed to provide resin emulsion particles with an average diameter size of, for example, in embodiments from about 50 nm to about 250 nm, in other embodiments from about 120 to about 180 nanometers.

The emulsified resin particles in the aqueous medium may have a submicron size, for example of about 1 μm or less, in embodiments about 500 nm or less, such as from about 10 nm to about 500 nm, in embodiments from about 50 nm to about 400 nm, in other embodiments from about 100 nm to about 300 nm, in some embodiments about 200 nm. Adjustments in particle size can be made by modifying the ratio of water to resin flow rates, solvent concentration, and solvent composition.

Toner

The emulsion thus formed as described above may be utilized to form toner compositions by any method within the purview of those skilled in the art. In embodiments, the polyester emulsion produced above, including the charge control agent, may be contacted with a colorant, optionally in a dispersion, and other additives to form a toner by an emulsion aggregation and coalescence process.

Colorants

As the colorant to be added, various known suitable colorants, such as dyes, pigments, mixtures of dyes, mixtures of pigments, mixtures of dyes and pigments, and the like, may be included in the toner. In embodiments, the colorant may be included in the toner in an amount of, for example, about 0.1 to about 35% by weight of the toner, or from about 1 to about 15% by weight of the toner, or from about 3 to about 10% by weight of the toner.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow G R, Hostafine Black T and Black T S, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850:1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

In embodiments, a pigment or colorant may be employed in an amount of from about 1% by weight to about 35% by weight of the toner particles on a solids basis, in other embodiments, from about 5% by weight to about 25% by weight.

Wax

Optionally, a wax may also be combined with the resin, charge control agent, and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1% by weight to about 25% by weight of the toner particles, in embodiments from about 5% by weight to about 20% by weight of the toner particles.

When a wax dispersion is used, the wax dispersion may include any of the various waxes conventionally used in emulsion aggregation toner compositions. Waxes that may be selected include waxes having, for example, an average molecular weight of from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Toner Preparation

Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins in combination with charge control agents described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin and charge control agent. The pH of the resulting mixture may be adjusted by an acid such as, for example, acetic acid, nitric acid or the like. In embodiments, the pH of the mixture may be adjusted to from about 4 to about 5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and subsequent coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles. In embodiments, the shell may include emulsified resin particles that include a charge control agent within the emulsion particles to enable charge of the toner particle.

Resins which may be utilized to form the shell include, but are not limited to, the amorphous resins described above. A single polyester resin may be utilized as the shell or, in embodiments, a first polyester resin may be combined with other resins to form a shell. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied utilizing any means within the purview of those skilled in the art. In embodiments, the shell resin may be in an emulsion. Thus, in embodiments, a polyester emulsion described above, with particles including charge control agents incorporated therein, may be applied to the aggregated particles, any surfactant removed, with the resin and charge control agent remaining on the aggregated particles as a shell layer.

Coalescence

Following aggregation to the desired particle size and the optional application of a shell resin described above, the particles may then be coalesced to the desired final shape, the coalescence being achieved by, for example, heating the mixture to a suitable temperature. This temperature may, in embodiments, be from about 0° C. to about 50° C. higher than the onset melting point of any crystalline polyester resin utilized in the particles, in other embodiments from about 5° C. to about 30° C. higher than the onset melting point of any crystalline polyester resin utilized. In embodiments the temperature for coalescence may be from about 40° C. to about 99° C., in embodiments from about 50° C. to about 95° C. Higher or lower temperatures may be used, it being understood that the temperature is a function of the resins used.

Coalescence may also be carried out with stirring, for example at a speed of from about 50 rpm to about 1,000 rpm, in embodiments from about 100 rpm to about 600 rpm. Coalescence may be accomplished over a period of from about 1 minute to about 24 hours, in embodiments from about 5 minutes to about 10 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In embodiments, toners of the present disclosure may be utilized as ultra low melt (ULM) toners. In embodiments, the dry toner particles of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.93 to about 1, in embodiments from about 0.95 to about 0.99 (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Additives

In embodiments, the toner particles may also contain other optional additives, as desired or required. For example, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, magnesium stearate, and/or calcium stearate, aluminum oxides, cerium oxides, titamium dioxide, and mixtures thereof. In embodiments, these metal oxides and other additives may improve toner relative humidity (RH) sensitivity, as well as flow and blocking properties. These metal oxides may include nano size amorphous particles that also have important functions during printing such as enabling development, and transfer of toner to the substrate.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1% by weight to about 5% by weight of the toner, in embodiments of from about 0.25% by weight to about 3% by weight of the toner. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000 and 6,214,507, the disclosures of each of which are hereby incorporated by reference in their entirety.

Uses

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A 2 liter-scale reactor is used for the following phase inversion emulsification (PIE) process. About 10 wt % of a high molecular-weight amorphous polyester resin, about 6.9 wt % of methyl ethyl ketone (MEK) and about 1.5 wt % of 2-Propanol (IPA) are added to a glass reaction vessel along with 1.0 weight percent zinc t-butyl salicylate based on the total weight amorphous polyester, heated up to about 45° C., and allowed to dissolve with stirring, for about 2 hours. About 1 ml of a 3.5M sodium hydroxide (NaOH) aqueous solution is then added dropwise to this resin solution and the combination is left to stir for about 10 minutes at a temperature of about 40° C. De-ionized water (DIW), heated to about 40° C. via a heat exchanger, is fed to the neutralized resin by a metering pump, (i.e. a Knauer pump) over about a 2 hour period. At this point approximately 625 ppm of a defoamer, TEGO FOAMEX 830™, can be added to the reactor loading port to control foaming during distillation.

The temperature of the reactor is then set to about 55° C. and a vacuum is slowly applied to the reactor and increased to about 27 Hg after 30 minutes. Vacuum is continued for about 2 hours to strip MEK/IPA down to 20 ppm. The polyester emulsion containing the incorporated zinc t-butyl salicylate charge control agent can now be used to prepare particles by the emulsion aggregation (EA) process by incorporating the polyester emulsion containing the zinc t-butyl salicylate charge control agent both in the particle core and shell, or in the shell only.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process of preparing an amorphous polyester resin emulsion configured for use in preparing a toner particle core and shell or shell only, comprising:

forming a resin mixture consisting essentially of optionally a surfactant, at least one amorphous polyester resin, at least one charge control agent and at least one organic solvent, wherein said at least one charge control agent comprises zinc t-butyl salicylate;

heating the resin mixture;

adding water and a solvent inversion agent to the resin mixture to form a disperse phase; and removing the at least one organic solvent to form a resin emulsion comprising a particle with the zinc t-butyl salicylate incorporated within the particle.

2. The process according to claim wherein the at least one organic solvent is selected from the group consisting of alcohols, esters, ethers, ketones, amines, and combinations thereof, in an amount from about 1 percent by weight to about 100 percent by weight of the resin.

3. The process according to claim 1, wherein the at least one organic solvent is selected from the group consisting of methanol, ethanol, propanol, isopropanol, butanol, ethyl acetate, methyl ethyl ketone, and combinations thereof, having a boiling point of from about 30° C. to about 120° C.

4. The process according to claim 1, wherein the resin mixture is heated to a temperature of from about 25° C. to about 90° C., and wherein the at least one solvent inversion agent is selected from the group consisting of methanol, ethanol, propanol, isopropanol, butanol, ethyl acetate, methyl ethyl ketone, and combinations thereof.

5. The process of claim 1, further comprising; contacting the resin emulsion with at least one colorant, an optional wax, and an optional surfactant; aggregating to form toner particles; and recovering the toner particles.

6. A process comprising:

adding at least one amorphous polyester resin, at least one charge control agent, and at least one organic solvent selected from the group consisting of alcohols, esters, ethers, ketones, amines, and combinations thereof, in an amount from about 10 percent by weight to about 90 percent by weight of the resin, to form a resin mixture, wherein said at least one charge control agent comprises zinc t-butyl salicylate;

heating the resin mixture;

adding at least one solvent inversion agent to form a diluted resin mixture;

adding water to the diluted resin mixture until phase inversion occurs to form a phase inversed resin mixture comprising a disperse phase; and removing the at least one organic solvent and the at least one solvent inversion agent from the phase inversed resin mixture to form a resin emulsion comprising a particle with the zinc t-butyl salicylate incorporated within the particle;

wherein when said resin emulsion is combined with at least an optional wax and an optional colorant, and aggregated, toner particles are obtained.

7. The process according to claim 6, wherein the resin emulsion is utilized to form a core of the toner particles.

8. The process according to claim 6, wherein the resin emulsion is utilized to form a shell of the toner particles.

9. The process according to claim 6, wherein the at least one organic solvent is selected from the group consisting of methanol, ethanol, propanol, isopropanol, butanol, ethyl acetate, methyl ethyl ketone, and combinations thereof, having a boiling point of from about 30° C. to about 120° C., wherein the resin mixture is heated to a temperature of from about 25° C. to about 90° C.

10. The process according to claim 6, wherein the at least one solvent inversion agent is selected from the group consisting of methanol, ethanol, propanol, isopropanol, butanol, ethyl acetate, methyl ethyl ketone, and combinations thereof.

* * * * *